US006427773B1

(12) United States Patent
Albers

(10) Patent No.: US 6,427,773 B1
(45) Date of Patent: Aug. 6, 2002

(54) FLOW THROUGH BYPASS TUBING PLUG

(75) Inventor: Tim Albers, Brooks (CA)

(73) Assignee: Lonkar Services Ltd., Alberta (CA)

( * ) Notice: Subject to any disclaimer, the term of this patent is extended or adjusted under 35 U.S.C. 154(b) by 0 days.

(21) Appl. No.: 09/666,640

(22) Filed: Sep. 21, 2000

(30) Foreign Application Priority Data

Jun. 12, 2000 (CA) ..... 2311215

(51) Int. Cl.[7] ..... E21B 34/10; E21B 34/14

(52) U.S. Cl. ..... 166/185; 166/188; 166/317; 166/324; 166/325

(58) Field of Search ..... 166/185, 188, 166/324, 325, 322, 332.5, 332.7, 317

(56) References Cited

U.S. PATENT DOCUMENTS

| | | | | |
|---|---|---|---|---|
| 1,919,510 A | * | 7/1933 | Harrington | 166/325 |
| 2,153,812 A | * | 4/1939 | Newton | 166/325 |
| 2,856,003 A | * | 10/1958 | Fredd | 166/126 |
| 2,919,709 A | * | 1/1960 | Schwegman | 166/325 |
| 3,090,443 A | * | 5/1963 | Bostock | 166/324 |
| 3,102,592 A | * | 9/1963 | Dollison | 166/186 |
| 3,141,506 A | * | 7/1964 | Thomas | 166/332.5 |
| 3,548,936 A | | 12/1970 | Kilgore et al. | |
| 3,606,927 A | | 9/1971 | True et al. | |
| 3,675,718 A | | 7/1972 | Kanady | |
| 3,701,382 A | | 10/1972 | Williams | |
| 3,809,157 A | * | 5/1974 | Dufrene | 166/185 |
| 3,847,223 A | | 11/1974 | Scott et al. | |
| 3,867,984 A | * | 2/1975 | Dufrene | 166/188 |
| 3,987,848 A | | 10/1976 | Canterbury | |
| 4,050,516 A | | 9/1977 | Canterbury | |
| 4,116,277 A | * | 9/1978 | McGee et al. | 166/188 |
| 4,260,020 A | | 4/1981 | Nelson et al. | |
| 4,586,569 A | | 5/1986 | Hyde | |
| 4,957,167 A | | 9/1990 | Schultz | |
| 5,332,042 A | | 7/1994 | Walter et al. | |
| 5,697,449 A | | 12/1997 | Hennig et al. | |
| 5,813,456 A | | 9/1998 | Milner et al. | |

OTHER PUBLICATIONS

Backer Packers Technical Data Manual, "Baker Bypass Blanking Plug With Removable Mandrel" Product Nos. 806–87, 806–88 & 806–89 dated Apr. 15, 1979 (4 pages).
Backer Oil Tools, "Flow Control Systems" Models "FSR", "FSG", "FWG", "RZG", "FMH", "RKH", "M", and "H" (pp. 16–18 and 33–34).
OTIS Engineering Catalog, "Type 'P' Equalizing Prong and Valve" dated Mar. 1970 (1 page).

* cited by examiner

*Primary Examiner*—Hoang Dang
(74) *Attorney, Agent, or Firm*—Terrence N. Kuharchuk; Rodman & Rodman

(57) ABSTRACT

A tubing plug is adapted for insertion into a tubing string for sealing the tubing string. The tubing plug is comprised of a housing having an outer surface, wherein the housing is adapted for insertion in the tubing string such that an annulus is defined between the tubing string and the outer surface of the housing and wherein the housing defines a fluid passage therethrough, the fluid passage having an upper end and a lower end. A sealing mechanism is associated with the housing for sealing the annulus and a two-way fluid bypass is provided for selectively permitting a flow of a fluid across the sealing mechanism. Finally, a one-way valve is located at the lower end of the fluid passage for selectively permitting a flow of a fluid in a first direction from the upper end to the lower end of the fluid passage and for preventing a flow of a fluid in a second direction from the lower end to the upper end of the fluid passage.

19 Claims, 2 Drawing Sheets

FLOW THROUGH BYPASS TUBING PLUG

FIELD OF INVENTION

The present invention relates to a tubing plug adapted for insertion into a tubing string for sealing the tubing string. More particularly, the present invention relates to a tubing plug providing a two-way fluid bypass and a one-way valve. Preferably, the one-way valve is pressure actuated by a flow of a fluid through the tubing plug.

BACKGROUND OF INVENTION

Retrievable tubing plugs are used in the oil or petroleum industry for temporarily isolating a portion of a tubing string contained within a wellbore. Specifically, the tubing plug is inserted within the tubing string at a desired downhole location in the wellbore for the purpose of temporarily plugging or sealing the tubing string, thus enabling completion or servicing operations to be carried out in the tubing string above the tubing plug. Typically, the tubing plug is run in and out of the tubing string using wireline equipment or fishing tools.

Conventional tubing plugs, which may also be referred to in the industry as blanking plugs, are designed as two-way plugs or seals. In other words, when the tubing plug is set in position within the tubing string, the tubing plug restricts or inhibits the flow of fluids through the tubing string across or about the tubing plug in both directions. The flow of fluids is inhibited through or across the tubing plug both externally and internally. The tubing plug is sealed internally or otherwise configured to prevent any internal fluid flow through the tubing plug. In addition, the tubing plug is sealed externally by sealing between the outer surface of the tubing plug and the inner surface of the surrounding tubing string to prevent any flow of fluid externally about the tubing plug.

However, it is preferable during the placement of the tubing plug in the tubing string to permit fluid to flow through or across the tubing plug to avoid a piston effect whereby the tubing plug pressurizes the fluid below it as it passes through the tubing string. Once the tubing string is in place at the desired location in the tubing string, the tubing plug is closed to permit the tubing plug to perform its plugging or sealing function in both directions.

Further, tubing plugs are preferably removable from the tubing string after use. However, if the pressure in the portion of the tubing string above the tubing plug is greater than the pressure in the portion of the tubing string below the tubing plug, difficulties will be encountered with the removal of the tubing plug from the tubing string. Conversely, if, the portion of the tubing string below the tubing plug has a greater pressure than the portion of the tubing string above the tubing plug, there is a tendency for the tubing plug, along with the wireline or retrieval tool, to be "shot" or "kicked" uphole by the pressure imbalance or differential during the removal process, resulting in wireline breakage, lost tools and other associated dam age and expenses. Thus, in order to facilitate the removal of the tubing plug from the tubing string, it is again desirable to be able to permit fluid to flow through or across the tubing plug in order to equalize the pressure above and below the tubing plug.

As a result, tubing plugs have been developed which provide a fluid bypass or bypass port which permits the flow of fluids across or about the tubing plug. These tubing plugs are typically referred to as "bypass tubing plugs."

A first style of bypass tubing plug, such as that manufactured by Baker Oil Tools as Model "FSR"™ Bypass Blanking Plug Product No. 806-06, has an automatic bypass to permit pressure equalization across the tubing plug in both directions. The bypass is automatically held open by the running tool while the tubing plug is being lowered into the tubing string to permit a flow of fluid across the tubing plug. The bypass is automatically closed when the running tool is released to enable the tubing plug to perform its plugging function. The bypass is then reopened when the running tool is reconnected with the tubing plug to permit pressure equalization and a flow of fluid across the tubing plug in order to facilitate the removal of the tubing plug from the tubing string. Alternatively, pressures can be equalized across the tubing plug by breaking a secondary equalizing plug using a special tool imparting a downward impact.

A second style of bypass tubing plug, such as that manufactured by Baker Oil Tools as Model "FSG"™ Bypass Blanking Plug with Removable Mandrel Product No. 806-07, includes a "removable mandrel" or "equalizing prong" which is moved axially either to close off a bypass port in the tubing plug or to open the bypass port to permit fluid flow and pressure equalization in both directions across the tubing plug. Typically, the mandrel has three positions. A first lower position of the mandrel results in the bypass port being open and is used to permit a flow of fluid through or across the tubing plug during lowering of the tubing plug into the tubing string. A second intermediate position closes off the bypass port during use of the tubing plug to facilitate its plugging function. A third upward position results in the mandrel being removed from the tubing plug to open the bypass port once again to permit a flow of fluid through or across the tubing plug in order to facilitate pressure equalization.

As indicated, upon closure of the fluid bypass or bypass port in each of these tubing plugs, the tubing plug substantially seals the tubing string and prevents the flow of fluid through or across the tubing plug. However, it may be desirable in some circumstances to be able to pump a fluid through the tubing string following the placement or landing of the tubing plug within the tubing string.

Further, these tubing plugs typically provide a relatively small fluid bypass or bypass port therein. As a result, the fluid bypass or bypass port tends to be susceptible to plugging or blockage, particularly when used in wells having high viscosity fluids or experiencing the settling of significant wellbore debris in the tubing string. Plugging of the bypass or ports may cause difficulties whenever a differential pressure is experienced in the tubing string across the tubing plug, particularly during the removal of the tubing plug from the tubing string.

For example, U.S. Pat. No. 4,586,569 issued May 6, 1986 to Hyde describes a retrievable fluid control valve including, from top to bottom, a valve housing, a bypass means and a sealing means for seating in a seating nipple of a tubing string to seal the tubing string annulus. A cavity within the valve housing communicates with a fluid passageway extending downwards through the bypass means and the sealing means. Further, an upper port is provided through the valve housing for communicating fluid between the annulus (above the sealing means) and the upper end of the cavity. A movable valve member blocks the passage of fluid between the annulus and the upper end of the cavity. When a pressurized fluid is pumped down the tubing string annulus (above the sealing means), the movable valve member is moved upwardly away from the upper end of the cavity to permit fluid to flow through the upper port and then downwardly through the cavity, the bypass means and the seal means. The bypass means is normally closed and includes a lower port for communicating fluid between the fluid passageway and the annulus (above the sealing means).

To remove the fluid control valve of Hyde from the tubing string, the downward flow of the pressurized fluid is interrupted. As a result, the movable valve member is moved downwardly towards the upper end of the cavity to block the passage of fluid through the upper port. Further, the lower port in the bypass means is opened to permit fluid to bypass the sealing means by flowing from the fluid passageway to the annulus (above the sealing means).

However, no mechanism is provided by Hyde for clearing or flushing the lower port in the event of blockage. Thus, there may be difficulties in equalizing a differential pressure in the tubing string above and below the sealing means. For instance, further pumping of pressurized fluid down the tubing string annulus (above the sealing means) and through the upper port is unlikely to clear the lower port as a result of the specific configuration of the control valve. Specifically, the control valve is configured such that the lower port communicates with the fluid passageway at a location below the valve member and above the sealing means. As a result, during downward pumping of the pressurized fluid, the fluid pressure in the fluid passageway adjacent the innermost end of the lower port is unlikely to differ significantly from the fluid pressure in the tubing string annulus (above the sealing means) adjacent the outermost end of the lower port.

Further examples of various valve assemblies disposed within a tubing string are provided by U.S. Pat. No. 3,847,223 issued Nov. 12, 1974 to Scott et. al. and U.S. Pat. No. 4,957,167 issued Sep. 18, 1990 to Schultz. In addition, various valve assemblies and packing assemblies have been adapted for connection into or with the tubing string and are inserted into the casing string or wellbore as an integral part of the tubing string. Examples of these valve and packing assemblies are provided by U.S. Pat. No. 3,548,936 issued Dec. 22, 1970 to Kilgore et. al., U.S. Pat. No. 3,606,927 issued Sep. 21, 1971 to True et. al., U.S. Pat. No. 3,675,718 issued Jul. 11, 1972 to Kanady, U.S. Pat. No. 3,701,382 issued Oct. 31, 1972 to Williams, U.S. Pat. No. 3,987,848 issued Oct. 26, 1976 to Canterbury, U.S. Pat. No. 4,050,516 issued Sep. 27, 1977 to Canterbury, U.S. Pat. No. 4,260,020 issued Apr. 7, 1981 to Nelson et. al., U.S. Pat. No. 5,332,042 issued Jul. 26, 1994 to Walter et. al., U.S. Pat. No. 5,697,449 issued Dec. 16, 1997 to Hennig et. al. and U.S. Pat. No. 5,813,456 issued Sep. 29, 1998 to Milner et. al.

Thus, there remains a need in the industry for an improved tubing plug adapted for insertion into the tubing string for sealing the tubing string. Further, there is a need for an improved bypass tubing plug which permits the pumping of fluids therethrough while positioned or landed within the tubing string. As well, there is a need for a bypass tubing plug which is configured to facilitate the equalization of pressures within the tubing string across the tubing plug, including facilitating the flushing or clearing of any blocked or clogged bypass ports in the tubing plug.

SUMMARY OF INVENTION

The within invention relates to a tubing plug adapted for insertion into the tubing string for sealing the tubing string. Further, the within invention relates to a bypass tubing plug which permits the pumping or flow of fluids therethrough, particularly while positioned or landed within the tubing string. More particularly, the within invention relates to a tubing plug having both a two-way fluid bypass for selectively permitting a flow of a fluid across an external sealing mechanism of the tubing plug and a one-way valve for selectively permitting a flow of a fluid though the tubing plug. The two-way fluid bypass and the one-way valve are particularly configured to facilitate the equalization of pressures within the tubing string across the tubing plug. Further, the two-way fluid bypass and the one-way valve are particularly configured to facilitate the flushing or clearing of the fluid bypass in the event that it becomes blocked or clogged.

In one aspect of the invention, the invention is comprised of a tubing plug adapted insertion into a tubing string for sealing the tubing string, the tubing plug comprising:

(a) a housing having an outer surface, wherein the housing is adapted for insertion in the tubing string such that an annulus is defined between the tubing string and the outer surface of the housing, and wherein the housing defines a fluid passage therethrough, the fluid passage having an upper end and a lower end;

(b) a sealing mechanism associated with the housing for sealing the annulus;

(c) a two-way fluid bypass for selectively permitting a flow of a fluid across the sealing mechanism; and (d) a one-way valve located at the lower end of the fluid passage for selectively permitting a flow of a fluid in a first direction from the upper end to the lower end of the fluid passage and for preventing a flow of a fluid in a second direction from the lower end to the upper end of the fluid passage.

As stated, the housing defines a fluid passage therethrough having an upper end and a lower end. The upper end and the lower end of the fluid passage may communicate with the outer surface or exterior of the housing in any manner and at any position or location along the housing or at an upper end or a lower end thereof such that the flow of the fluid may pass through the fluid passage of the housing. Preferably, the fluid passage extends through the housing substantially between the upper and lower ends of the housing. Thus, preferably, the upper end of the fluid passage is associated with the upper end of the housing and the lower end of the fluid passage is associated with the lower end of the fluid passage.

The housing may be comprised of a single unitary tubular member or element or it may be comprised of two or more tubular members or elements connected, attached or affixed together, either permanently or detachably, to provide the housing. For instance, two or more tubular members or elements may be permanently connected, attached or affixed together, such as by welding or gluing, to provide an integral housing unit. Alternatively, two or more tubular members or elements may be detachably connected, attached or affixed together, such as by a threaded connection between adjacent ends, in order to facilitate the manufacture and maintenance of the tubing plug.

The one-way valve is located at the lower end of the fluid passage defined by the housing. In other words, the one-way valve is located adjacent or in close proximity to the lower end of the fluid passage. In the preferred embodiment, the housing is comprised of an upper housing section and a lower housing section which together define the fluid passage extending therethrough. Further, in the preferred embodiment, the one-way valve is located within the lower housing section. The upper housing section and the lower housing section may be permanently connected, attached or affixed together, such as by welding or gluing. However, in the preferred embodiment, the upper housing section and the lower housing section are detachably connected, attached or affixed together by a threaded connection between adjacent ends to facilitate the attachment of the one-way valve with the balance of the tubing plug and the removal of the one-way valve therefrom.

Further, in the preferred embodiment, from top to bottom in the first direction from the upper end of the housing to the lower end of the housing, the tubing plug includes the sealing mechanism, the two-way fluid bypass and the one-way valve. Further, in the preferred embodiment, the upper end of the fluid passageway is located above the sealing mechanism. Further, although the upper end of the fluid passage is preferably at, adjacent or in proximity to the upper end of the housing, the upper end of the fluid passage may be located at any location or position between the upper end of the housing and the sealing mechanism. In addition, in the preferred embodiment, the lower end of the fluid passage is located below the sealing mechanism. Further, although the lower end of the fluid passage is preferably at, adjacent or in proximity to the lower end of the housing, the lower end of the fluid passage may be located at any location or position between the sealing mechanism and the lower end of the housing.

As stated, the fluid bypass selectively permits the flow of fluid across the sealing mechanism. Accordingly, the fluid bypass is preferably actuatable between a closed condition inhibiting the flow of fluid across the sealing mechanism and an open condition permitting the flow of fluid across the sealing mechanism. The fluid bypass may be in the closed condition while being run downhole or while being positioned within the tubing string. However, preferably, the fluid bypass is in the open condition while being run downhole or while being positioned within the tubing string to facilitate placement in the tubing string and is actuated to the closed condition subsequent to being positioned, set or landed at the desired downhole position within the tubing string. In either event, the fluid bypass is subsequently actuatable to the open condition downhole to permit equalization of pressures within the tubing string across the sealing mechanism to facilitate the removal of the tubing plug from the tubing string.

The fluid bypass may be comprised of any mechanism or structure capable of and suitable for bypassing the sealing mechanism or permitting the flow of fluid across the sealing mechanism. However, preferably, the fluid bypass is associated with the fluid passage. More preferably, the fluid bypass communicates with the fluid passage of the housing at a location between the upper end of the fluid passage and the valve. Although the fluid bypass may communicate with the fluid passage in any manner, in the preferred embodiment, the fluid bypass is comprised of a bypass port extending between the fluid passage and the outer surface of the housing. Thus, the flow of fluid may pass through the bypass port between the fluid passage and the annulus between the outer surface of the housing and the tubing string. In addition, in the preferred embodiment, the bypass port is located between the sealing mechanism and the valve located at the lower end of the fluid passage.

Thus, the flow of fluid may bypass the sealing mechanism by passing from the annulus below or downhole of the sealing mechanism through the bypass port into the fluid passage and continuing in the second direction in the fluid passage towards the upper end of the fluid passage located above or uphole of the sealing mechanism. Conversely, the flow of fluid may bypass the sealing mechanism by flowing in the first direction through the fluid passage from the upper end of the fluid passage located above or uphole of the sealing mechanism, through the bypass port and into the annulus below or downhole of the sealing mechanism.

The sealing mechanism may be comprised of any type or configuration of sealing mechanism, sealing structure, sealing assembly or annular seal capable of and suitable for sealing the annulus. In addition, the sealing mechanism may be associated with the housing, and particularly the outer surface of the housing, in any manner permitting the functioning of the seal mechanism of described herein. For instance, the sealing mechanism may be permanently or detachably connected, attached, affixed or mounted with or within the outer surface of the housing by any suitable structure therefore. Further, the sealing mechanism may be fixed to maintain a fixed spatial relationship with the outer surface of the housing or it may be expandable and retractable in order to facilitate the placement or positioning of the tubing plug within the tubing string. In the preferred embodiment, the sealing mechanism is comprised of a fixed annular seal mounted about the outer surface of the housing and adapted for seating within a compatible tubing string nipple or landing joint. Thus, the annulus is sealed upon landing or seating of the annular seal within the nipple which is located at a predetermined downhole position within the tubing string.

The one-way valve may be any type of valve and may be comprised of any valving structure or mechanism capable of, and suitable for, selectively permitting a flow of a fluid in the first direction and capable of preventing a flow of a fluid in the second direction. Further, the one-way valve may be actuated in any manner and by any actuation mechanism, structure or process. For instance, the one-way valve may be comprised of an actuating mechanism which mechanically actuates the valve between a flow permitting condition and a flow preventing condition. However, in the preferred embodiment, the one-way valve is a pressure actuated valve such that the valve permits the flow of fluid in the first direction upon exposure of the valve to a fluid pressure which is equal to or greater than a predetermined actuating pressure of the valve.

Further, the one-way valve is preferably comprised of a valve seat defined by the lower end of the fluid passage and a valve member for sealingly engaging the valve seat, wherein the valve member is movable axially within the fluid passage in relation to the valve seat for selectively sealingly engaging and disengaging the valve seat. The valve member may be moved axially within the fluid passage in either direction to engage the valve member with the valve seat. In other words, the valve seat may either be located above or uphole of the valve member or it may be located below or downhole of the valve member. In the preferred embodiment, the valve member moves axially within the fluid passage in the first direction to disengage the valve seat to permit the flow of fluid in the first direction. Thus, the valve seat is located above or uphole of the valve member such that movement of the valve member in the first direction towards the lower end of the fluid passage results in the disengagement of the valve member from the valve seat, while movement of the valve member in the second direction towards the upper end of the fluid passage results in the engagement of the valve member within the valve seat.

More particularly, the valve member is preferably comprised of an actuating surface, wherein the valve member disengages the valve seat upon exposure of the actuating surface to a fluid pressure which is equal to or greater than the predetermined actuating pressure of the valve. Thus, in the preferred embodiment, exposure of the actuating surface to a fluid pressure equal to or greater than the predetermined actuating pressure of the valve moves the valve member axially within the fluid passage in the first direction to disengage the valve seat to permit the flow of fluid in the first direction. Accordingly, the actuating surface faces upwardly within the fluid passage or towards the upper end of the fluid passage in the preferred embodiment.

Each of the valve member and the valve seat may have any shape or configuration compatible with the other such that the valve member is capable of sealingly engaging the valve seat. In the preferred embodiment, the valve member is comprised of a valve head for sealingly engaging the valve seat and a valve stem extending from the valve head. Thus, the valve head is comprised of the actuating surface and is particularly shaped or configured to be compatible with the valve seat. Further, the valve stem preferably extends in a direction opposite to the actuating surface or in the direction of the lower end of the fluid passage. Further, one or more seals or sealing assemblies is preferably associated with at least one of the valve seat and the valve head for providing a seal therebetween. In the preferred embodiment, at least one seal is associated with the valve head for enhancing the sealing engagement of the valve head within the valve seat.

As well, although the one-way valve may be any type of valve and have any configuration compatible with selectively permitting a one-way fluid flow through the fluid passage as described herein, in the preferred embodiment, the valve is a poppet valve. Thus, the valve member is preferably comprised of a poppet and the valve seat is preferably comprised of a compatible poppet seat. Any shape or configuration of poppet and compatible poppet seat capable of sealingly engaging each other may be used.

In addition, the tubing plug is further preferably comprised of a biasing mechanism associated with the valve member for urging the valve member in the second direction towards the valve seat. The biasing mechanism may be comprised of any device, apparatus, structure or member capable of and suitable for urging the valve member towards the valve seat. In the preferred embodiment, the biasing mechanism is comprised of at least one spring for urging the valve member into sealing engagement with the valve seat.

Further, the biasing mechanism may be associated with the valve member in any manner permitting the biasing member to urge the valve member directly or indirectly towards the valve seat. For instance, the biasing mechanism, such as one or more springs, may be either located above or uphole of the valve member or located below or downhole of the valve member. Further, the biasing mechanism may act directly upon the valve member or it may act indirectly through one or more intermediate or intervening parts, members or elements.

In the preferred embodiment, the biasing mechanism, being a spring, is located below or downhole of the valve member adjacent to the valve member such that the spring can act directly upon the valve member to urge it towards the valve seat. Further, the valve member is preferably further comprised of a biasing surface in opposition to the actuating surface of the valve member, wherein the biasing mechanism acts upon the biasing surface. Accordingly, the biasing surface faces downwardly within the fluid passage or towards the lower end of the fluid passage in the preferred embodiment. Further, the biasing mechanism preferably provides a biasing force which acts upon the valve member in opposition to the pressure of the fluid flowing in the first direction within the fluid passage. Accordingly, in the preferred embodiment, exposure of the actuating surface to a fluid pressure equal to or greater than the predetermined actuating pressure of the valve overcomes the biasing force of the biasing mechanism to move the valve member axially within the fluid passage in the first direction to disengage the valve seat. Conversely, exposure of the actuating surface to a fluid pressure less than the predetermined actuating pressure of the valve permits the biasing force of the biasing mechanism either to maintain the valve member in engagement with the valve seat or to urge the valve member axially within the fluid passage towards the valve seat for engagement therewith.

Further, in the preferred embodiment in which the valve member is comprised of a valve head and a valve stem, the valve head is comprised of the biasing surface. Further, the valve stem preferably extends from the biasing surface in the direction of the lower end of the fluid passage. Thus, in the preferred embodiment, the biasing mechanism is comprised of at least one spring acting upon the biasing surface of the poppet for urging the poppet into sealing engagement with the poppet seat.

In addition, the lower end of the fluid passage is preferably associated with a biasing chamber for containing the biasing mechanism therein such that the biasing mechanism urges the valve member in the second direction towards the valve seat. Thus, in the preferred embodiment, at least one spring is contained within the biasing chamber. Further, the biasing chamber is connected with the lower end of the fluid passage such that fluid flow in the first direction passes from the lower end of the fluid passage into the biasing chamber. More particularly, the lower end of the fluid passage is preferably associated with, and more preferably extends through, the lower end of the housing. Thus, the lower end of the housing is connected with the biasing chamber such that fluid flow in the first direction passes from the lower end of the housing into the biasing chamber.

The lower end of the housing and the biasing chamber may be permanently connected, attached or affixed together, such as by welding or gluing. However, in the preferred embodiment, the lower end of the housing and the biasing chamber are detachably connected, attached or affixed together by a threaded connection between adjacent ends to facilitate the manufacture and maintenance of the valve.

Further, the biasing chamber has a chamber wall, wherein the chamber wall defines at least one port extending therethrough such that the flow of fluid through the port is permitted. As a result fluid flowing in the first direction into the biasing chamber may exit the biasing chamber through the port or ports into the tubing string. As well, in the preferred embodiment in which the valve member is comprised of a valve head and a valve stem, the valve stem preferably extends from the valve head into the biasing chamber.

Finally, the tubing plug may be further comprised of a releasable locking mechanism for fixedly maintaining the valve member in sealing engagement with the valve seat by preventing the axial movement of the valve member within the fluid passage in the first direction, wherein the locking mechanism releases the valve member to permit axial movement in the first direction upon exposure of the actuating surface of the valve member to a fluid pressure which is equal to or greater than the predetermined actuating pressure of the valve.

The releasable locking mechanism may be comprised of any apparatus, device, mechanism or structure capable of and suitable for fixedly maintaining the valve member in sealing engagement with the valve seat by preventing the axial movement of the valve member except upon exposure of the valve member to a fluid pressure which is equal to or greater than the predetermined actuating pressure of the valve. However, the releasable locking mechanism is preferably comprised of at least one frangible member associated with the valve member. More preferably, the releasable locking mechanism is comprised of at least one shear pin associated with the valve member. Each of the frangible members or shear pins is selected to break or shear, and thus release the valve member, upon the application of a predetermined force thereto supplied by the exposure of the valve to a fluid pressure which is equal to or greater than the predetermined actuating pressure of the valve.

Each frangible member, and preferably each shear pin, may be associated with the valve member in any manner permitting the frangible member or shear pin to prevent the axial movement of the valve member with the fluid passage. Further, each frangible member or shear pin may be associated with any part, portion or surface of the valve member permitting the frangible member or shear pin to prevent the axial movement of the valve member. For instance, the frangible member or shear pin may extend between the valve seat and the adjacent surface of the valve member. However, as stated, in the preferred embodiment, the valve member is comprised of a valve head and a valve stem extending from the valve head into the biasing chamber within the chamber wall. In this case, at least one shear pin extends between the chamber wall and the valve stem to prevent the axial movement of the valve member.

Each shear pin may extend between the chamber wall and the valve stem at any position or location along the length of the valve stem. However, the valve stem preferably extends to a lower end located below or downhole of the spring within the biasing chamber. In order to avoid any interference with the operation of the spring, each shear pin preferably extends between the chamber wall and the valve stem at, adjacent or in proximity to the lower end of the valve stem.

BRIEF DESCRIPTION OF DRAWINGS

Embodiments of the invention will now be described with reference to the accompanying drawings, in which.

DETAILED DESCRIPTION

Figure 1:
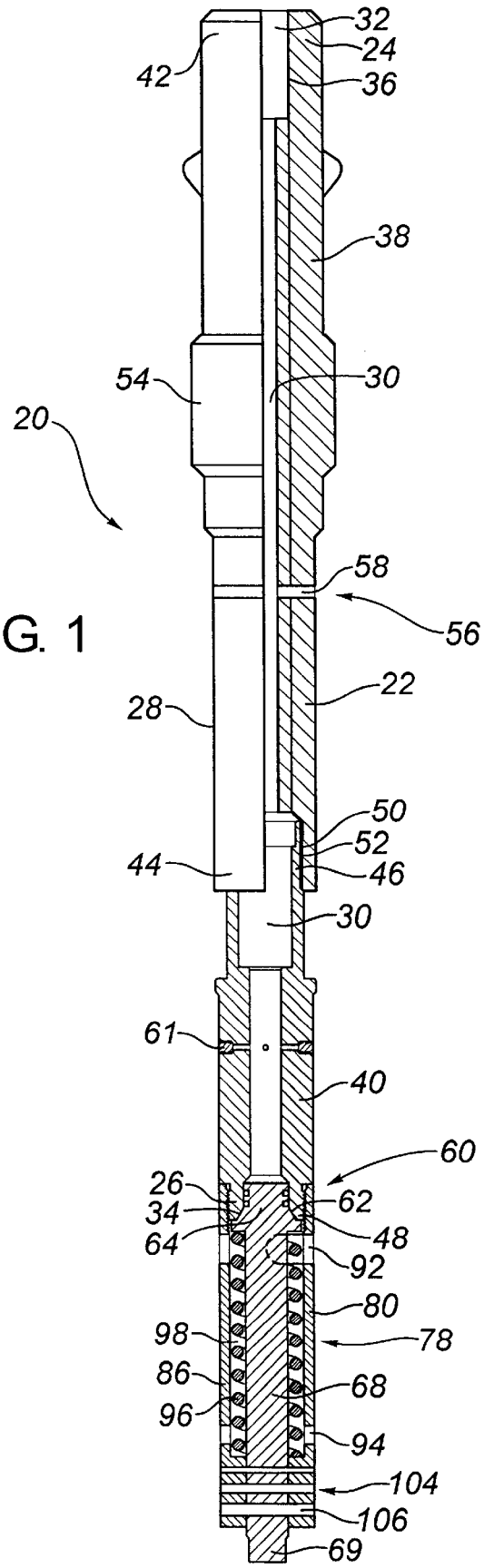
FIG. 1 is a side view of a preferred embodiment of a tubing plug of the within invention including a one-way valve.
Figure 2:
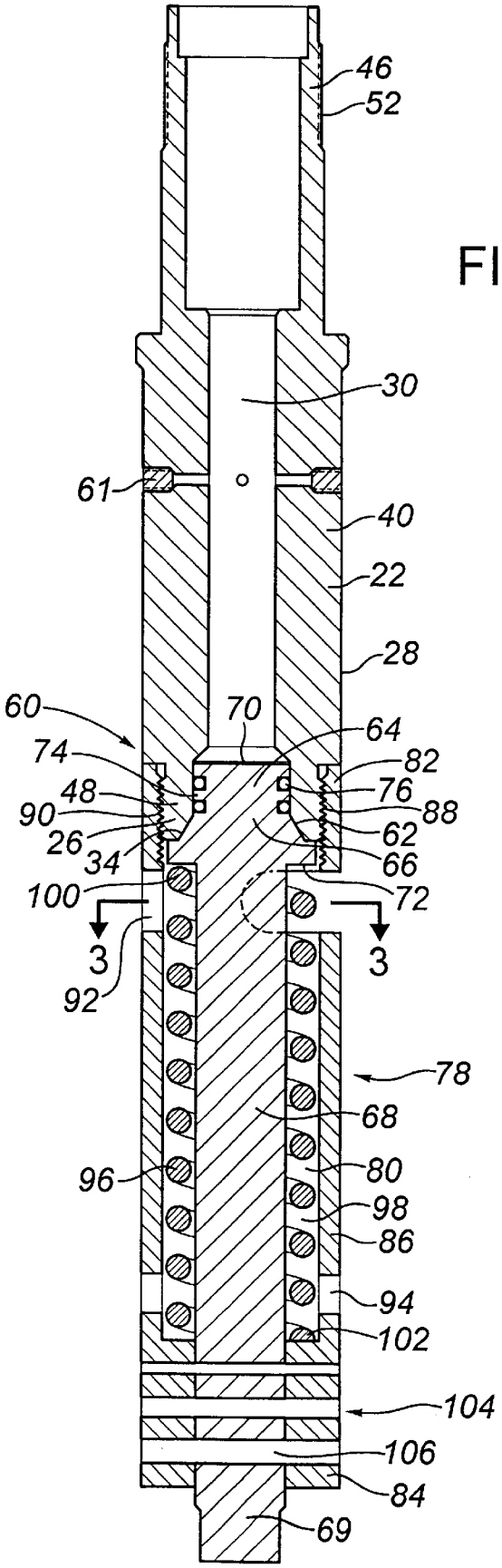
FIG. 2 is a longitudinal sectional view of the one-way valve shown in FIG. 1, including a biasing chamber connected therewith.
Figure 3:
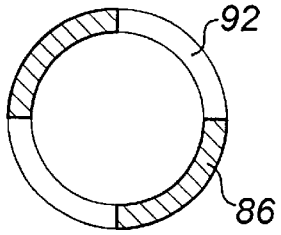
FIG. 3 is a cross-sectional view of the biasing chamber taken along lines 3—3 of FIG. 2.

Referring to FIG. 1, the within invention is directed at a tubing plug (20) adapted for insertion into a tubing string for sealing the tubing string. The tubing string extends through or within a borehole or wellbore, cased or open hole, from the surface to a desired downhole formation such that fluids within the formation may be pumped or retrieved to the surface through the tubing string and such that fluids may be pumped or injected downhole from the surface through the tubing string to the formation. Typically, the formation is a hydrocarbon producing formation such that oil, typically heavy oil, is pumped therefrom. As stated, the tubing plug (20) is adapted for insertion into the tubing string such that the tubing string may be selectively sealed or temporarily plugged as desired or required for the performance of any particular operations within the tubing string, such as completion or servicing operations to be carried out in the tubing string above the tubing plug (20).

The tubing plug (20) is comprised of a housing (22) having an upper end (24), a lower end (26) and an outer surface (28). The housing (22) is particularly adapted for insertion in the tubing string such that an annulus is defined between the tubing string and the outer surface (28) of the housing (22). Preferably, the housing (22) is an elongated tubular member, element or sub sized or configured for insertion in the tubing string.

In addition, the housing (22) defines a fluid passage (30) therethrough permitting the flow of a fluid therein. The fluid passage (30) has an upper end (32) and a lower end (34). Each of the upper end (32) and the lower end (34) permit the communication of fluid into and out of the fluid passage (30) and into and out of the housing (22) defining the fluid passage (30). Preferably, the fluid passage (30) extends substantially between the upper and lower ends (24, 26) of the housing (22). In other words, the upper end (32) of the fluid passage (30) preferably extends through the upper end (24) of the housing (22) and the lower end (34) of the fluid passage (30) preferably extends through the lower end (26) of the housing (22). Although the fluid passage (30) may take any course within the housing (22) between the upper and lower ends (24, 26), the fluid passage (30) is preferably relatively centrally located within the housing (30) and has a relatively large diameter facilitating the flow of a fluid therethrough.

The upper end (24) of the housing (22) is adapted for connection or attachment with a compatible running tool (not shown), such as wireline equipment or a fishing tool, such that the tubing plug (20) may be inserted into the tubing string and retrieved therefrom by the running tool. The running tool may permit the pumping of a fluid therethrough such that a pressurized fluid may be pumped from the surface therethrough into the upper end (32) of the fluid passage (30). Thus, the connection with the running tool may provide for fluid communication between a bore of the running tool and the fluid passage (30) at the upper end (24) of the housing (22). In the preferred embodiment, a threaded connection is provided between the upper end (24) of the housing (22) and the running tool. More particularly, the upper end (24) of the housing (22) is preferably comprised of a threaded internal surface (36) or threaded box connector for engaging a compatible threaded external surface or threaded pin connector of the running tool.

Further, in the preferred embodiment, the housing (22) is comprised of an upper housing section (38) and a lower housing section (40) which together define the fluid passage (30) extending therethrough. The upper housing section (38) has a first end (42) defining the upper end (24) of the housing (22) and a second end (44). Similarly, the lower housing section (40) has a first end (46) and a second end (48) defining the lower end (26) of the housing (22). The second end (44) of the upper housing section (38) and the first end (46) of the lower housing section (40) may be integrally formed with each other to provide a single unitary housing (22). However, preferably, the second end (44) of the upper housing section (38) and the first end (46) of the lower housing section (40) are connected, attached or affixed together, either permanently or detachably, to provide the housing (22). More preferably, the second end (44) of the upper housing section (38) and the first end (46) of the lower housing section (40) are detachably connected, attached or affixed together.

In the preferred embodiment, a threaded connection is provided between adjacent ends (44, 46) of the upper and lower housing sections (38, 40). More particularly, the second end (44) of the upper housing section (38) is preferably comprised of a threaded internal surface (50) or threaded box connector which engages a compatible threaded external surface (52) or threaded pin connector which comprises the first end (46) of the lower housing section (40).

Further, each of the upper and lower housing sections (38, 40) may further be comprised of two or more tubular elements, members or subs interconnected together to form of each of the upper and lower housing sections (38, 40). In this case, the various tubular elements, members or subs may be connected, attached or affixed together, either permanently or detachably to form the upper and lower housing sections (38, 40).

In addition, the tubing plug (20) is further comprised of a sealing mechanism (54) associated with the housing (22) for sealing the annulus between the tubing string and the outer surface (28) of the housing (22). The sealing mechanism (54) is particularly associated with the upper housing section (38) and is adapted, in the preferred embodiment, for landing or seating within a compatible landing nipple or joint provided by the tubing string. Further, the tubing plug (20) is comprised of a two-way fluid bypass (56) for selectively permitting a flow of a fluid across the sealing mechanism (54). The two-way fluid bypass (56) is also particularly associated with the upper housing section (38). Thus, in the preferred embodiment, both the two-way fluid bypass (56) and the sealing mechanism (54) are associated with the upper housing section (38).

More particularly, in the preferred embodiment, the sealing mechanism (54) is located or positioned about the outer surface (28) of the upper housing section (38) between the first and second ends (42, 44). Thus, the upper end (32) of the fluid passage (30) is located above the sealing mechanism (54) and the fluid passage (30) extends downwardly through the sealing mechanism (54) to the second end (44) of the upper housing section (38).

The fluid bypass (56) selectively permits a flow of a fluid across the sealing mechanism (54). More particularly, in the preferred embodiment, the fluid bypass (56) may be actuated between a closed condition inhibiting a flow of a fluid across the sealing mechanism (54) and an open condition permitting a flow of a fluid across the sealing mechanism (54). Preferably, the fluid bypass (56) is in the open condition while being run downhole or while being positioned within the tubing string to facilitate placement in the tubing string and is actuated to the closed condition subsequent to being positioned, set or landed at the desired downhole position within the tubing string. When the tubing plug (20) is to removed from the tubing string, the fluid bypass (56) may be actuated to the open condition to permit equalization of pressures within the tubing string across the sealing mechanism (54) to facilitate the removal of the tubing plug (20) from the tubing string.

In the preferred embodiment, the fluid bypass (56) is associated with the fluid passage (30), and particularly, with the fluid passage (30) within the upper housing section (38). Specifically, the fluid bypass (56) communicates with the fluid passage (30) in the upper housing section (38) at a location between the sealing mechanism (54) and the second end (44) of the upper housing section (38).

Further, in the preferred embodiment, the fluid bypass (56) is comprised of at least one bypass port (58) extending between the fluid passage (30) and the outer surface (28) of the upper housing section (38). Thus, a flow of a fluid may pass through each bypass port (58) between the fluid passage (30) and the annulus defined between the outer surface (28) of the upper housing section (38) and the tubing string. Further, as described above, in the preferred embodiment, each bypass port (58) is located within the upper housing section (38) between the sealing mechanism (54) and the second end (44) of the upper housing section (38).

Thus, a flow of a fluid may bypass the sealing mechanism (54) by passing from the annulus below or downhole of the sealing mechanism (54), through each bypass port (58) into the fluid passage (30) within the upper housing section (38) and continue through the fluid passage (30) towards the first end (42) of the upper housing section (38) to exit from the upper end (32) of the fluid passage (30) located above or uphole of the sealing mechanism (54). Similarly, a flow of a fluid in an opposite direction may bypass the sealing mechanism (54) by flowing into the upper end (32) of the fluid passage (30) at the first end (42) of the upper housing section (38) which is located above or uphole of the sealing mechanism (54), through each bypass port (58) and into the annulus below or downhole of the sealing mechanism (54).

The upper housing section (38) including the sealing mechanism (54) and the two-way fluid bypass (56) may be comprised of the first style of bypass tubing plug described in the background above and as exemplified by the bypass tubing plug manufactured by Baker Oil Tools as Model "FSR"™ "Bypass Blanking Plug" Product No. 806-06. However, in the preferred embodiment, the upper housing section (38) including the sealing mechanism (54) and the two-way fluid bypass (56) are comprised of the second style of bypass tubing plug described in the background above and as exemplified by the bypass tubing plug manufactured by Baker Oil Tools as Model "FSG"™ "Bypass Blanking Plug with Removable Mandrel" Product No. 806-07 which includes a "removable mandrel" or "equalizing prong."

Further examples of the second style of bypass tubing plug which may comprise. the upper housing section (38), sealing mechanism (54) and two-way fluid bypass (56) of the tubing plug (20) of the within invention are provided by Baker Oil Tools as "Baker Bypass Blanking Plug with Removable Mandrel" Product No. 806-87 (Model "FSG"™), Product No. 806-88 (Model "FWG"™), Product No. 806-89 (Model "RZG"™), Product No. 806-90 (Model "FMH"™) and Product No. 806-91 (Model "RKH"™).

Final examples of a bypass tubing plug which may comprise the upper housing section (38), sealing mechanism (54) and two-way fluid bypass (56) of the tubing plug (20) of the within invention are provided by Baker Oil Tools as "Single-Trip Bypass Blanking Plug" Model "M"™ and "Bypass Blanking Plug with Removable Mandrel" Model "H"™.

In each of these examples, to comprise the upper housing section (38) of the tubing plug (20) of the within invention, the bypass tubing plug must provide for or permit a flow of fluid through a fluid passage between an upper end and a lower end of the bypass tubing plug (as described above for the upper housing section (38)). Preferably, the lower end of the bypass tubing plug, such as in preferred Model "FSG"™ "Bypass Blanking Plug with Removable Mandrel," is sealed by a removable member or element which inhibits the flow of fluid through the fluid passage (30) of the bypass tubing plug. Typically, the removable member or element is comprised of a "blanking plug" positioned at the lower end. As a result, these bypass tubing plugs are often referred to as "Bypass Blanking Plugs." The blanking plug seals the fluid passage of the bypass tubing plug so that fluids cannot pass through the fluid passage out of the lower end while the bypass tubing plug is in use. For use with the tubing plug (20) of the within invention, the blanking plug would be removed from the lower end of the bypass tubing plug to provide an upper housing section (38) permitting a flow of fluid to pass therethrough.

The tubing plug (20) of the within invention is further comprised of a one-way valve (60) located at the lower end (34) of the fluid passage (30). Thus, the one-way valve (60) is located adjacent or in close proximity to the lower end (34) of the fluid passage (30). In the preferred embodiment, the one-way valve (60) is located at the lower end (26) of the housing (22) and thus, is particularly located within the lower housing section (40). Further, although the one-way valve (60) may be associated with the fluid passage (30) within the lower section (40) at any position or location along the length of the fluid passage (30) therein, the one-way valve (60) is preferably located at, adjacent or in proximity to the second end (48) of the lower housing section (40).

As a result, as discussed above, the "blanking plug" may be removed from a standard bypass blanking plug to provide the upper housing section (38), and the lower housing section (40) including the one-way valve (60) may be attached or connected therewith in the manner described above. As a result, it is possible to retrofit a standard bypass blanking plug to include the one-way valve (60) and thus provide for the tubing plug (20) of the within invention. To facilitate the retrofitting of a standard bypass plug, the blanking plug is preferably threadably engaged with the lower end of the standard bypass tubing plug. Thus, removal of the blanking plug provides the threaded internal surface (50) at the second end (44) of the upper housing section (38) to be engaged with the threaded external surface (52) at the first end (46) of the lower housing section (40).

The one-way valve (60) selectively permits the a flow of a fluid in a first direction from the upper end (32) to the lower end (34) of the fluid passage (30) and prevents a flow of a fluid in a second direction from the lower end (34) to the upper end (32) of the fluid passage (30). Further, in the preferred embodiment, the one-way valve (60) is a pressure actuated valve such that the valve (60) permits the flow of fluid in the first direction upon exposure of the valve (60) to a fluid pressure which is equal to or greater than a predetermined actuating pressure of the valve (60). The actuating pressure of the valve (60) may be predetermined or preselected based upon the operating parameters or conditions likely to be encountered within the tubing string and likely to be encountered within the tubing plug (20) following the placement of the tubing plug (20).

When the fluid bypass (56) has been actuated to the closed condition, fluid maybe pumped in the first direction through the tubing plug (20) as a result of the presence of the one-way valve (60) in the tubing plug (20). Pumping of a fluid through the tubing plug (20) following the landing or setting of the tubing plug (20) within the tubing string may be desirable for a number of reasons. Further, as discussed previously, the fluid bypass (56) may become plugged or clogged. As a result, when the tubing plug (20) is to be removed from the tubing string, the fluid bypass (56) may not permit the equalization of pressures across the sealing mechanism (54) following actuation to the open condition. In this instance, further pumping of pressurized fluid through the tubing plug (20) may assist in the equalization of pressures and may assist in the clearing of any blockages contained in the fluid bypass (56) due to the specific configuration of the tubing plug (20).

Specifically, the tubing plug (20) is configured such that the bypass port (58) of the fluid bypass (56) communicates with the fluid passage (30) at a location above the valve (60) and below the sealing mechanism (54). As a result, during pumping of the pressurized fluid downward in the fluid passage (30) or in a first direction form the upper end (32) to the lower end (34), the fluid pressure in the fluid passage (30) adjacent the innermost end of the bypass port (58) may be increased to a level greater than the fluid pressure in the annulus adjacent the outermost end of the bypass port (58), thus tending to force the fluid through the bypass port (58) and thereby clearing any blockages within the bypass port (58).

One or more valve bypass ports (61) may be defined by the lower housing section (40) extending from the fluid passage (30) to the outer surface (28) of the housing (22) at a position or location along the length of the lower housing section (40) above or uphole of the valve (60). As a result of this particular location, fluids within the fluid bypass (30) may be permitted to bypass the valve (60) by flowing through the valve bypass port (61). Further, one or more valve bypass ports (61) are preferably adjustable for permitting the passage of fluid therethrough when the fluid pressure in the fluid bypass (30) exceeds a preset adjustable limit.

The one-way valve (60) is preferably comprised of a valve seat (62) defined by the lower end (34) of the fluid passage (30) and a valve member (64) for sealingly engaging the valve seat (62). The valve member (64) is movable axially within the fluid passage (30) in relation to the valve seat (62) for selectively sealingly engaging and disengaging the valve seat (62). In the preferred embodiment, the valve seat (62) is downwardly facing such that the valve seat (62) faces towards the lower end (34) of the fluid passage (30). Further, the valve seat (62) is located above or uphole of the valve member (64). As a result, movement of the valve member (64) axially within the fluid passage (30) in the first direction moves the valve member (64) away from the valve seat (62) to disengage the valve member (64) from the valve seat (62). As a result, movement of the valve member (64) in the first direction permits a flow of a fluid in the first direction in the fluid passage (30). Movement of the valve member (64) axially within the fluid passage (30) in the second direction moves the valve member (64) towards the valve seat (62) to engage the valve member (64) within the valve seat (62). Engagement of the valve member (64) within the valve seat (62)prevents any further flow of fluid in the first direction and also prevents any flow of fluid in the second direction.

Further, the valve member (64) is preferably comprised of a valve head (66) for sealingly engaging the valve seat (62) and a valve stem (68) extending from the valve head (66) to a lower end (69). More particularly, in the preferred embodiment, the valve (60) is a poppet valve, wherein the valve member (64) is comprised of a poppet and the valve seat (62) is comprised of a compatible poppet seat.

Any shape or configuration of valve head (66) and compatible valve seat (62) capable of sealingly engaging each other may be used. However, in the preferred embodiment, the valve head (66) has an upper surface (70), an opposing lower surface (72) and an outer surface (74). The upper surface (70) provides or comprises an actuating surface of the valve member (64). The upper surface or actuating surface (70) faces upwardly within the fluid passage (30) or towards the upper end (32) of the fluid passage (30) such that the actuating surface (70) is exposed to the flow of the fluid in the first direction through the fluid passage (30). As a result, the valve member (64), and particularly the valve head (66), disengages the valve seat (62) upon exposure of the actuating surface (70) to a fluid pressure which is equal to or greater than the predetermined actuating pressure of the valve (60).

The lower surface (72) opposes the upper or actuating surface (70) of the valve head (66). Accordingly, the lower surface (72) faces downwardly within the fluid passage (30) or towards the lower end (34) of the fluid passage (30). The valve stem (68) extends from the lower surface (72) in a direction away from the valve head (66).

The outer surface (74) of the valve head (66) extends between the upper and lower surfaces (70, 72) and is particularly shaped or configured for sealingly engaging the valve seat (62). In order to enhance or facilitate the sealing engagement, at least one seal or sealing assembly is preferably associated with either or both of the valve seat (62) and the outer surface (74) of the valve head (66). In the preferred embodiment, two annular seals (76), such as an O-ring, are mounted about the outer surface (74) of the valve head (66).

In addition, the tubing plug (20) is further preferably comprised of a biasing mechanism (78) for urging the valve member (64), and particularly the valve head (66), in the second direction towards the valve seat (62). In the preferred embodiment, the lower surface (72) of the valve head (66) provides or comprises a biasing surface of the valve member (64). Thus, the biasing surface (72) of the valve member (64) is in opposition to the actuating surface (70) of the valve member (64). In the preferred embodiment, the biasing mechanism (78) acts upon the biasing surface (72) to urge the valve head (66) towards the valve seat (62).

Further, the biasing mechanism (78) is preferably located below or downhole of the valve member (64). As a result, in the preferred embodiment, the tubing plug (20) is further comprised of a biasing chamber (80), associated with the lower end (34) of the fluid passage (30), for containing the biasing mechanism (78) therein such that the biasing mechanism (78) may act upon the biasing surface (72). The biasing chamber (80) is preferably comprised of a tubular element or member having an upper end (82), a lower end (84) and a chamber wall (86) extending therebetween. The upper end (82) of the biasing chamber (80) is connected with the lower end (34) of the fluid passage (30) such that fluid flow in the first direction passes from the lower end (34) of the fluid passage (30) into the biasing chamber (80). More particularly, in the preferred embodiment, the upper end (82) of the biasing chamber (80) is connected with the second end (48) of the lower housing section (40), being the lower end (26) of the housing (22).

The second end (48) of the lower housing section (40) and the upper end (82) of the biasing chamber (80) may be permanently connected, attached or affixed together, such as by welding or gluing. However, in the preferred embodiment, the second end (48) of the lower housing section (40) and the upper end (82) of the biasing chamber (80) are detachably connected, attached or affixed together, preferably by a threaded connection between adjacent ends (48, 82). More particularly, the second end (48) of the lower housing section (40) is preferably comprised of a threaded external surface (88) or threaded pin connector which engages a compatible threaded internal surface (90) or threaded box connector which comprises the upper end (82 of the biasing chamber (80).

Further, the chamber wall (86) of the biasing chamber (80) defines at least one port (92) extending therethrough such that a flow of fluid through the port (92) is permitted. In the preferred embodiment, two ports (92) are provided. As a result, fluid flowing in the first direction past the valve (60), from the lower end (26) of the housing (22) and into the biasing chamber (80) exits the biasing chamber (80) through the ports (92) and passes into the tubing string. Similarly, fluid from the tubing string may pass through the ports (92) into the biasing chamber (80) to equalize the biasing chamber (80) and to assist the biasing mechanism (78) in urging the valve head (66) towards the valve seat (62). In addition, where desirable, the chamber wall (86) of the biasing chamber (80) may further define one or more additional equalizing ports (94) extending therethrough to permit or facilitate the equalization of pressures internal and external of the biasing chamber (80).

In the preferred embodiment, the valve stem (68) of the valve member (64) extends from the valve head (66) into the biasing chamber (80) through the upper end (82). Further, for reasons described below, the lower end (69) of the valve stem (68) extends to, and preferably through, the lower end (84) of the biasing chamber (80). Further, the valve stem (68) is movable axially within the biasing chamber (80). Specifically, the valve stem (68) moves axially within the biasing chamber (80) in conjunction with the axial movement of the valve head (66) within the fluid passage (30).

In the preferred embodiment, the biasing mechanism (78) is comprised of at least one spring (96) for urging the valve member (64) into sealing engagement with the valve seat (62). More particularly, the spring (96) is contained within the biasing chamber (78) in an annular space (98) provided between the valve stem (68) and the chamber wall (86). An upper end (100) of the spring (96) acts directly upon the biasing surface (72) of the valve member (64), while a lower end (102) of the spring (96) abuts against the lower end (84) of the biasing chamber (80). Thus, movement of the valve member (64) axially in the first direction results in the compression of the spring (96) between the biasing surface (72) and the lower end (84) of the biasing chamber (80).

The biasing mechanism (78), and particularly the spring (96), provides a biasing force which acts upon the valve member (64) in opposition to the pressure of the fluid flowing in the first direction within the fluid passage (30). Accordingly, the actuating pressure of the valve (60) is determined, at least in part, by the biasing force of the spring (96) and the pressure of the fluid within the biasing chamber (80). For instance, the one-way valve (60) will permit the flow of fluid in the first direction upon the exposure of the actuating surface (70) to a fluid pressure equal to or greater than the predetermined actuating pressure of the valve (60), being determined at least in part by the combination of the biasing force of the spring (96) and the fluid pressure in the biasing chamber (80).

The tubing plug (20) is also preferably further comprised of a releasable locking mechanism (104) for fixedly maintaining the valve member (64) in sealing engagement with the valve seat (62) by preventing axial movement of the valve member (64) within the fluid passage (30) in the first direction. The locking mechanism (104) releases the valve member (64) to permit axial movement in the first direction upon exposure of the actuating surface (70) of the valve member (64) to a fluid pressure which is equal to or greater than the predetermined actuating pressure of the valve (60).

More particularly, the releasable locking mechanism (104) is preferably associated with the valve stem (68) of the valve member (64) and prevents the axial movement of the valve stem (68) within the biasing chamber (80). Further, the releasable locking mechanism (104) is preferably comprised of at least one frangible member, preferably a shear pin (106), extending between the chamber wall (80) and the valve stem (68).

Although each shear pin (106) may extend between the chamber wall (80) and the valve stem (68) at any position or location along the length of the valve stem (68), each shear pin (106) preferably extends between the chamber wall (80) and the valve stem (68) at, adjacent or in proximity to the lower end (69) of the valve stem (68). More particularly, each shear pin (106) preferably extends between the valve stem (68) and the chamber wall (80) as the valve stem (68) extends through the lower end (84) of the biasing chamber (80). As a result, the releasable locking mechanism (104) does not interfere with the operation of the spring (96) within the biasing chamber (80).

In the preferred embodiment, each shear pin (106) is selected to break or shear, and thus release the valve member (64), upon the application of a predetermined force thereto supplied by the exposure of the actuating surface (70) of the valve member (64) to a fluid pressure which is equal to or greater than the predetermined actuating pressure of the valve (60).

Accordingly, the actuating pressure of the valve (60) is also determined, at least in part, by the breaking or shearing force of each shear pin (106). Thus, the one-way valve (60) will permit the flow of fluid in the first direction upon the exposure of the actuating surface (70) to a fluid pressure equal to or greater than the predetermined actuating pressure of the valve (60), being determined at least in part by the combination of the biasing force of the spring (96), the fluid pressure in the biasing chamber (80) and the breaking or shearing force of each shear pin (106).

The embodiments of the invention in which an exclusive property or privilege is claimed are defined as follows:

1. A tubing plug adapted for insertion into a tubing string for sealing the tubing string, the tubing plug comprising:

(a) a housing having an outer surface, wherein the housing is adapted for insertion in the tubing string such that an annulus is defined between the tubing string and the outer surface of the housing, and wherein the housing defines a fluid passage therethrough, the fluid passage having an upper end and a lower end;

(b) a sealing mechanism associated with the housing for sealing the annulus;

(c) a two-way fluid bypass for selectively permitting a flow of a fluid across the sealing mechanism;

(d) a one-way valve located at the lower end of the fluid passage for selectively permitting a flow of a fluid in a first direction from the upper end to the lower end of the fluid passage upon exposure of the valve to a fluid pressure which is equal to or greater than a predetermined actuating pressure of the valve and for preventing a flow of a fluid in a second direction from the lower end to the upper end of the fluid passage, wherein the one-way valve is comprised of a valve seat defined by the lower end of the fluid passage and a valve member for sealingly engaging the valve seat and wherein the valve member is movable axially within the fluid passage in relation to the valve seat for selectively sealingly engaging and disengaging the valve seat; and (e) a releasable locking mechanism for fixedly maintaining the valve member in sealing engagement with the valve seat by preventing the axial movement of the valve member within the fluid passage, wherein the locking mechanism releases the valve member to permit axial movement within the fluid passage upon exposure of the valve to a fluid pressure which is equal to or greater than the predetermined actuating pressure of the valve.

2. The tubing plug as claimed in claim 1 wherein the fluid bypass is actuatable between a closed condition inhibiting the flow of fluid across the sealing mechanism and an open condition permitting the flow of fluid across the sealing mechanism.

3. The tubing plug as claimed in claim 2 wherein the fluid bypass communicates with the fluid passage of the housing at a location between the upper end of the fluid passage and the valve.

4. The tubing plug as claimed in claim 3 wherein the fluid bypass is comprised of a bypass port extending between the fluid passage and the outer surface of the housing.

5. The tubing plug as claimed in claim 4 wherein the bypass port is located between the sealing mechanism and the valve.

6. The tubing plug as claimed in claim 3 wherein the valve member moves axially within the fluid passage in the first direction to disengage the valve seat to permit the flow of fluid in the first direction.

7. The tubing plug as claimed in claim 6 wherein the valve member is comprised of an actuating surface and wherein the locking mechanism releases the valve member and the valve member disengages the valve seat upon exposure of the actuating surface to a fluid pressure which is equal to or greater than the predetermined actuating pressure of the valve.

8. The tubing plug as claimed in claim 6 further comprising a biasing mechanism associated with the valve member for urging the valve member in the second direction towards the valve seat.

9. The tubing plug as claimed in claim 8 wherein the biasing mechanism is comprised of at least one spring for urging the valve member into sealing engagement with the valve seat.

10. The tubing plug as claimed in claim 9 wherein the valve member is further comprised of a biasing surface in opposition to the actuating surface of the valve member and wherein the spring acts upon the biasing surface.

11. The tubing plug as claimed in claim 8 wherein the valve member is comprised of a poppet and wherein the valve seat is comprised of a compatible poppet seat.

12. The tubing plug as claimed in claim 11 wherein the biasing mechanism is comprised of at least one spring for urging the poppet into sealing engagement with the poppet seat.

13. The tubing plug as claimed in claim 8 wherein the releasable locking mechanism is comprised of at least one frangible member associated with the valve member.

14. The tubing plug as claimed in claim 13 wherein the releasable locking mechanism is comprised of at least one shear pin associated with the valve member.

15. The tubing plug as claimed in claim 14 wherein the lower end of the fluid passage is associated with a biasing chamber for containing the biasing mechanism therein such that the biasing mechanism urges the valve member in the second direction towards the valve seat.

16. The tubing plug as claimed in claim 15 wherein the biasing chamber is connected with the lower end of the fluid passage such that fluid flow in the first direction passes from the lower end of the fluid passage into the biasing chamber.

17. The tubing plug as claimed in claim 16 wherein the biasing chamber has a chamber wall and wherein the chamber wall defines at least one port extending therethrough such that the flow of fluid through the port is permitted.

18. The tubing plug as claimed in claim 17 wherein the valve member is comprised of a valve head for sealingly engaging the valve seat and a valve stem extending from the valve head into the biasing chamber and wherein at least one shear pin extends between the chamber wall and the valve stem.

19. The tubing plug as claimed in claim 18 wherein the biasing mechanism is comprised of at least one spring for urging the valve member into sealing engagement with the valve seat and wherein the spring is contained within the biasing chamber.

* * * * *